United States Patent [19]

Fouroux et al.

[11] 4,416,143

[45] Nov. 22, 1983

[54] CONNECTOR STRAIGHTENING TOOL

[76] Inventors: Claude H. Fouroux, 8632 Cypress Ave., Cypress, Calif. 90630; Craig W. Boardman, 393 Sunrise Cir., Costa Mesa, Calif. 92627

[21] Appl. No.: 424,355

[22] Filed: Sep. 27, 1982

[51] Int. Cl.[3] ..... B21D 3/14

[52] U.S. Cl. ..... 72/479

[58] Field of Search ..... 72/479, 481, 476, 457, 72/458, 370

[56] References Cited

U.S. PATENT DOCUMENTS

| | | | |
|---|---|---|---|
| 1,276,235 | 8/1918 | Loranger | 72/479 |
| 1,505,409 | 8/1924 | Mueller | 72/476 |
| 2,746,325 | 5/1956 | Kjellberg | 72/479 |
| 3,041,649 | 7/1962 | Isenhour | 72/476 |
| 3,417,603 | 12/1968 | Loew | 72/479 |
| 3,837,213 | 9/1974 | Guzzo | 72/479 |
| 3,892,123 | 7/1975 | Baldwin | 72/479 |

*Primary Examiner*—Gene P. Crosby

*Attorney, Agent, or Firm*—Gordon K. Anderson

[57] ABSTRACT

A hand held tool having a round body with one end containing a stepped plug in cylindrical form. The plug conforming to the inside diameter of an electrical connector with an internal hollow providing clearance for projections within the connector. The body further having an opening surrounding the plug forming a diametrical cavity corresponding to the outside diameter of an electrical connector. When inserted into a connector, the tool forces the walls of the device into alignment straightening them into functional tolerance. The body also contains a handle for operator convenience in either a tee shape, a raised head or a shank separating the gripping handle from the body.

9 Claims, 10 Drawing Figures

CONNECTOR STRAIGHTENING TOOL

BACKGROUND OF THE INVENTION

1. Field of the Invention

This invention relates to improvements in metal forming tools with elongated extensions fixed to the tool face in general, more particularly to hand held tools for straightening the shell of bayonet type electrical connectors, both on the inside and outside surfaces.

2. Description of Prior Art

Previously, tools for straightening electrical connectors, specifically BNC type, have been limited to devices that reshape the internal diameter only. Loew in U.S. Pat. No. 3,417,603 issued Dec. 24, 1968 teaches a tool having a tip portion with a maximum outer dimension slightly less than the internal dimension of an outer body portion of the electrical connector. This permits frictional contact of the tip portion inside the connector for reshaping the outer body to the maximum dimension. This tip further contains a tapered lower portion permitting initial insertion into the bent shell. While the art of straightening cylindrical objects by insertion of an internal plug is well known, recently BNC connectors have additional problems. The tolerance of this type of connector allows little variation in roundness of the outer shell as the mating plug must innerface and conform exactly to the internal and external diameter of the shell. When this style of connector was developed by the military some four decades ago, BNC designating a Bayonet Navy connector, the signals conducted through the joint were in the 50 Mega Hertz range. With advancing technology, the frequency has been elevated to as high as 4 Gega Hertz. The tolerance on the connector has become increasingly important, as the higher frequencies may have the wave length changed by the connector if the fit is not in exact conformance. At lower frequencies this tolerance is less significant, however, if the shell is out of round the plug may be inserted into the connector, but a ground float may change the actual signal impulse. It has been noted that extremely high frequency actually radiates waves from the bayonets protrusions located on the side of the shell. With this problem in mind, prior art simply relies upon a frictional internal contact which, if the shell is slightly oval in shape, does not entirely conform even though attachment is possible. The material tends to spring back to its oval shape after the tool is removed leaving irregular surface contact and the subsequent aberation in the signal.

For background purposes, and as indicative of the art to which the invention relates, reference may be made to U.S. Pat. No. 1,276,235 issued to Loranger and U.S. Pat. No. 3,041,649 of Isenhour.

SUMMARY OF THE INVENTION

The variety of electronic coaxial connectors having a bayonet latching arrangement commonly referred to as BNC series has the shell fabricated of a metal such as brass and beryllium copper. While this material has the structural integrity suitable for the application, the necessity for a thin wall in the shell precludes some occasional damage by bending or deforming the axial surface. This damage usually occurs in moving the component upon which the device is attached where the weight mass is much greater than the strength of the shell. Slight contact with a hard surface may be enough to deform the shell to the extent that the mating plug will not enter, rendering the entire apparatus useless until the connector function is corrected. The expense or replacement far overshadows the component cost as wire terminations requiring soldering or special crimping tools are necessitated. Prior art utilizes a tool to accomplish this straightening procedure with the connector in place, however, in recent years the tolerance for roundness of the device has taken on much greater importance.

The need has existed to improve this tool to meet the conformity demands of the present advanced technology. It is, therefore, the primary object of the invention to provide a tool that straightens both the inside and outside of the shell simultaneously and holds the tolerance of roundness within the limits established by original equipment manufacturers of the device. This improvement takes advantage of the tapered end of a hollow cylindrical plug to apply force with the tip entering the deformed body first bringing the shell into partial concentricity. As the plug continues into the shell, the full diameter is in contact with the upper portion. At this condition the outer shell embraces the body of the tool and is forced into a cavity between the body and the plug. This surface contact provides a swaging action to the shell allowing complete conformity to the plug. A twisting action and linear thrust is required to complete this swaging operation and render the plug useable. The body of the tool is contiguous with the bayonets and the end of the plug touch the inner surface of the plug simultaneously when complete insertion and radial forming is accomplished.

Another object applies the use of the invention to a variety of radio frequency connectors having bayonet-locking quick connect-disconnect coaxial features of the BNC series. The tool works easily well on in-line connectors, bulkhead jacks, panel jacks, solder receptacles, and the like, both military standard and commercial types.

Still another object provides a tool that is small and compact enough to easily fit into a tool box and of an economic range within the reach of most electronic technicians repairing such instrumentation or equipment.

Yet a further object utilizes a device that is easily understood and readily manipulated by hand. No special adaptation is required nor operating instructions are exacted, as its function is self-evident by title alone to one skilled in the art.

These and other objects and advantages of the present invention will become apparent from the subsequent detailed description of the preferred embodiment and the appended claims taken in conjunction with the accompanying drawing.

DESCRIPTION OF THE PREFERRED EMBODIMENT

Figure 1:
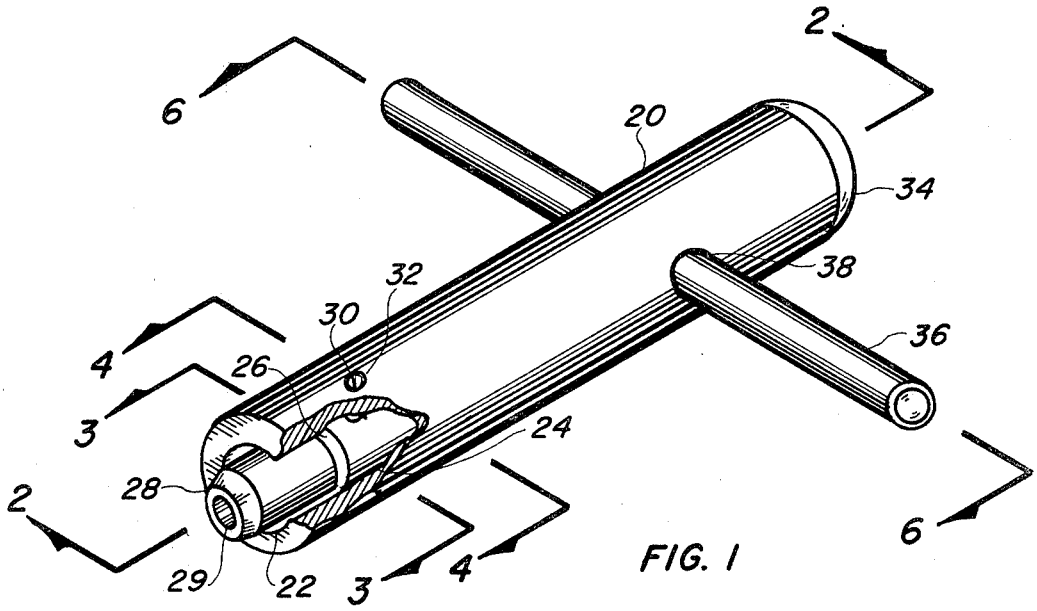
FIG. 1 is a partial isometric view of the preferred embodiment with one end partially cut-away to expose the internal configuration.
Figure 2:
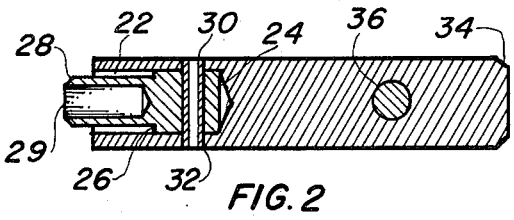
FIG. 2 is a longitudinal cross-sectional view of the preferred embodiment taken along lines 2—2 of FIG. 1.
Figure 3:
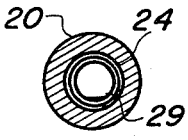
FIG. 3 is a cross-sectional view of the preferred embodiment taken along lines 3—3 of FIG. 1.
Figure 4:
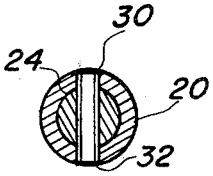
FIG. 4 is a cross-sectional view of the preferred embodiment taken along lines 4—4 of FIG. 1.
Figure 5:
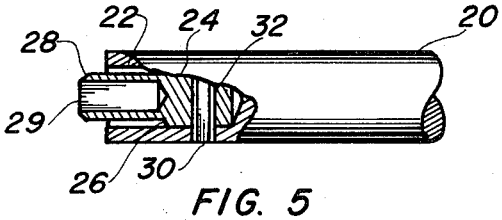
FIG. 5 is a partial elevation view of the preferred embodiment with one end partially cut-away exposing the plug and cavity.
Figure 6:
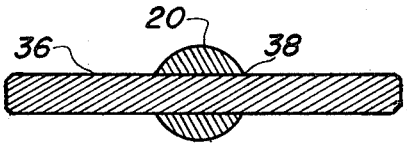
FIG. 6 is a sectional view of the preferred embodiment taken along lines 6—6 of FIG. 1.

Referring now more specifically to the referenced characters of the drawing, the invention in the preferred embodiment is best depicted in FIGS. 1 through 6, consists of a body 20 with a bore 22 in one end. This bore 22 is perhaps one quarter of the length of the body 20 and has straight sides. A hollow cylindrical plug 24 is inserted into the bore 22, partially extending on the exterior. The plug 24 further contains a stepped shoulder 26, perhaps half of its length, however, this length is not pertinent to its function. The shoulder 26 reduces the diameter of the plug 24 to the dimensional tolerance of the internal diameter of a BNC style coaxial connector. The end of the plug 24 further contains a taper 28 on the extended outside diameter. The plug 24 contains a hollow 29 in the extended end provided for clearance of projections within the workpiece. The plug 24 is maintained in the bore 22 with a compressible pin 30 commonly known as a "roll pin" formed in a radial C-shape. The ends do not touch each other maintaining tension on the outside walls of an aligned hole 32 through which the pin 30 is inserted.

Another embodiment of this attachment utilizes an interference fit between the inside diameter of the bore 22 and the outside diameter of the plug 24. This is accomplished by forcing the plug 24 into the bore 22 by external pressure utilizing the compression of the plug along with the expansion of the bore to maintain integrity of the fit.

Still another embodiment employs the use of an anaerobic chemical composition in liquid form such as registered trademark Locktite RC/601 RC/680 made by Locktite Corporation filling the interior space between the plug 24 and bore 22. This chemical has the properties that in the presence of metal and confined within close fitting parts will self-harden, without shrinking, to a plastic state conforming to the surface roughness of the joint, thereby maintaining integrity of the bond therebetween. These embodiments for attachment will function equally well to provide a permanent connection for these elements.

Likewise, the method of gripping may take a number of embodiments, also working equally well, each having a different element of comfort and utility to the user. The preferred embodiment, depicted in FIG. 1, takes advantage of an arcuate portion 34 on the end of the body 20 opposite the bore 22. This arcuate portion 34 conforms in shape to the palm of the operators hand while a tee handle 36 is forceably pressed into the body 20 through a hole 38 retaining the integrity of the position, allowing a gripping surface for the fingers. In this embodiment the tool is grasped by one hand with the arcuate portion 34 in the palm with the body extending between the fingers and the tee handle 36 positioned angularly allowing the fingers to clasp the surface. Insertion into the workpiece is allowed by applying linear force to the radiused end 34 and withdrawal is accomplished by pressure on the tee handle 36.

Figure 7:
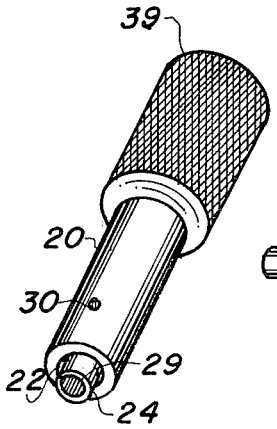
FIG. 7 is a partial isometric view of another embodiment having an annular shoulder integral with the body.

In another embodiment, illustrated in FIG. 7, the gripping means is accomplished by an annular shoulder 39 integral with the body 20 on the end opposite the bore 22. The shoulder 39 is larger in diameter than the body 20 and has a radiused head on the external end. The surface may be plain or knurled, as shown in FIG. 7, to improve the gripping surface. This embodiment takes advantage of a radiused end for the palm during insertion and is large enough to be manipulated by hand for the other operations.

Figure 8:
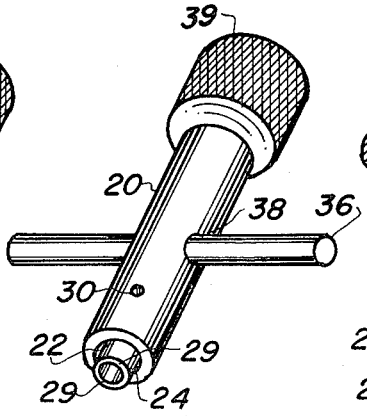
FIG. 8 is a partial isometric view of yet another embodiment having both an annular shoulder and a tee handle.
Figure 9:
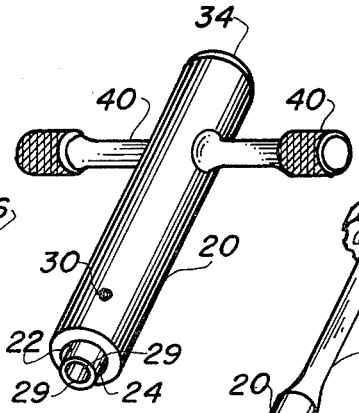
FIG. 9 is a partial isometric view of still another embodiment having a tee handle in a stepped configuration.

Yet another embodiment of the method of gripping is shown in FIG. 8, where the above two configurations are used in concert. FIG. 9 represents an embodiment not unlike its preferred counterpart, however, the tee handle 36 is knurled on the ends 40 and the shank between the ends and the body is reduced in diameter improving the comfort of the gripping surface and adding an asthetic quality to the handle.

Figure 10:
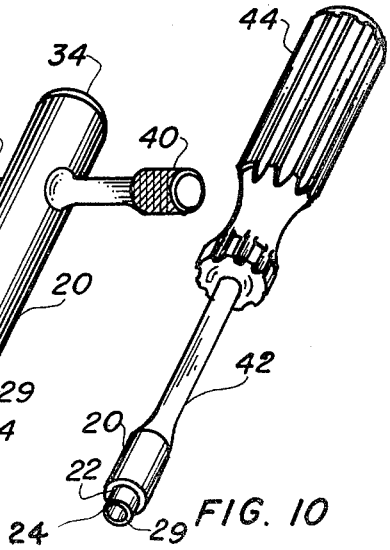
FIG. 10 is a partial isometric view of yet another embodiment having the body attached to a shank and handle.

Yet another embodiment of the gripping means appended to the body 20 employs an extended shank 42 with a handle 44 on the end. This configuration is depicted in FIG. 10 and utilizes a conventional tool handle, such as found on a screwdriver, nut driver, etcetera. The operators hand is, therefore, removed from being in close proximity to the workpiece and the movement required for manipulation is, therefore, extended. This embodiment also provides a lever arm allowing radial positioning to be accomplished.

The configuration of the tool provides a cavity between the plug 24 and the bore 22. This area is utilized by the workpiece which is a cylindrical shell of plated brass material the basic size of this area. In operation the connector has its mating part, usually a plug, removed and the tool is inserted into the shell. The tapered portion 28 enters the shell first preforming the material into a round shape on the internal diameter if it is deformed radially. The tool allows the connector material to flow in conformance to the shape of the plug until the body 20 contacts the outside connector surface simultaneously. This swaging action forces both the inside and outside surface into alignment within the cavity, removing dents and irregularities in the surface. A rotational movement may be employed while inserting the tool in the connector and force may be necessary in a linear direction to complete the swaging process. The gripping means employed in all of the disclosed embodiments allow manual pressure to be exerted to remove the tool from the work piece after the straightening action has been completed.

The application of the extended plug 24 beyond the body 20 in the initial operation allows badly distorted connectors to first be internally preformed prior to the swaging action on both sides as the plug procedes internally beyond the bayonets. As military and commercial standards dictate, the physical size of the so called BNC series connector a single tool fits all of styles in this series interchangeably.

While the invention has been described in complete detail and pictorially shown in the accompanying drawing, it is not to be limited to such details, since many changes and modifications may be in the invention without departing from the spirit and the scope thereof.

Hence, it is described to cover any and all modifications and forms which may come within the language and scope of the appended claims.

What is claimed is:

1. An improved hand held electrical connector shell straightening tool comprising:

(a) a body having a first and second end, said first end having a bore therein;

(b) a hollow cylindrical plug having a stepped shoulder and a tapered end, the extended portion of said shoulder being of a diameter to be insertably received within said bore in the first end of said body and defining a cavity between said plug and said bore for forceably receiving said electrical connector shell therebetween straightening said shell to conform to the inside diameter of the bore and simultaneously the outside of said cylindrical plug with the internal hollow portion of said cylinder providing clearance for projections within said electrical connector;

(c) means to attach said plug within said bore of the body for securing therewith; and, (d) gripping means appended to said body defining raised projections for hand manipulation thereof.

2. The invention as recited in claim 1 further comprising:

said hollow cylindrical plug extendng exteriorally to said first end of said body for forceably receiving said electrical connector shell.

3. The invention as recited in claim 1 wherein said body further comprises:

an arcuate portion on said second end for interfacing with the palm of ones hand when operated to straighten said connector shell.

4. The device according to claim 1 in which the means to attach said plug within said bore further comprises:

a compressible pin within a linear aperture extending through said body and said plug intimately embracing the walls of the aperture for attachment and retention thereof.

5. The apparatus as in claim 1 wherein said means to attach said plug within said bore further comprises:

an interference fit between said plug and said bore being forceably retained by compression of the body containing the bore and expansion of the plug within the bore.

6. The invention according to claim 1 wherein said means to attach said plug within said bore further comprises:

an anaerobic chemical composition in liquid form filling the inner space between said plug and bore having the characteristics that in the presence of metal will self-harden, without shrinkage, to a plastic state conforming to the surface roughness forming a unitized assembly maintaining continuity thereof.

7. The invention as recited in claim 1 wherein said gripping means appended to said body further comprises:

a tee handle forceably pressed into said body, further having a bore therethrough compressionally retaining said handle with the bore at right angles to the body with the tee handle extending on either side for gripping with the operators fingers providing torsional and linear manual control.

8. The device according to claim 1 or claim 7 in which the gripping means appended to said body further comprises:

an annular shoulder integral with said second end of the body having an extended diameter and radiused head of a size compatible with ones hand for gripping therewith.

9. The invention as recited in claim 1 wherein said gripping means appended to said body further comprise:

an extended shank with a handle on one end and said body on the other for gripping distal to said electrical connector shell.

* * * * *